US008708792B2

(12) United States Patent
Costa

(10) Patent No.: US 8,708,792 B2
(45) Date of Patent: Apr. 29, 2014

(54) GAMING DEVICE AND SYSTEM AND METHOD FOR PROVIDING POKER-BLACKJACK GAME

(75) Inventor: Peter Costa, Narborough (GB)

(73) Assignee: Two Black Nines, LLC, Los Angeles, CA (US)

( * ) Notice: Subject to any disclaimer, the term of this patent is extended or adjusted under 35 U.S.C. 154(b) by 0 days.

(21) Appl. No.: 13/396,183

(22) Filed: Feb. 14, 2012

(65) Prior Publication Data

US 2012/0149450 A1 Jun. 14, 2012

Related U.S. Application Data

(63) Continuation-in-part of application No. 12/717,819, filed on Mar. 4, 2010, now abandoned.

(60) Provisional application No. 61/249,849, filed on Oct. 8, 2009, provisional application No. 61/157,519, filed on Mar. 4, 2009.

(51) Int. Cl.
*A63F 1/00* (2006.01)

(52) U.S. Cl.
USPC ..... 463/11; 463/12; 463/13; 273/292

(58) Field of Classification Search
USPC ..... 463/11–13; 273/292
See application file for complete search history.

(56) References Cited

U.S. PATENT DOCUMENTS

| | | | | |
|---|---|---|---|---|
| 5,395,120 | A * | 3/1995 | Malek | 273/292 |
| 5,713,574 | A | 2/1998 | Hughes | |
| 5,873,571 | A | 2/1999 | Vaisman et al. | |
| 6,012,719 | A | 1/2000 | Webb | |
| 6,056,641 | A | 5/2000 | Webb | |
| 6,237,916 | B1 | 5/2001 | Webb | |
| 6,311,978 | B1 | 11/2001 | Moody | |
| 6,345,823 | B1 | 2/2002 | Webb | |
| 6,371,867 | B1 | 4/2002 | Webb | |
| 6,409,174 | B1 | 6/2002 | Demarest | |
| 6,481,719 | B2 | 11/2002 | Webb | |
| 6,523,831 | B2 | 2/2003 | Webb | |
| 6,609,711 | B1 | 8/2003 | Campbell | |
| 6,698,759 | B2 | 3/2004 | Webb et al. | |
| 6,749,200 | B2 * | 6/2004 | Yurkins | 273/292 |
| 6,877,748 | B1 * | 4/2005 | Patroni et al. | 273/292 |
| 7,108,265 | B1 | 9/2006 | Dargue | |
| 7,137,630 | B2 | 11/2006 | Yurkins | |
| 7,175,180 | B2 | 2/2007 | Webb | |
| 7,175,522 | B2 | 2/2007 | Hartl | |
| 7,416,187 | B2 | 8/2008 | Forster | |
| 7,993,191 | B2 | 8/2011 | Evans et al. | |
| 2001/0040344 | A1 | 11/2001 | Zahedi | |
| 2002/0195775 | A1 | 12/2002 | Webb et al. | |
| 2006/0255540 | A1 | 11/2006 | O'Hagan | |
| 2006/0267285 | A1 | 11/2006 | Webb et al. | |
| 2007/0210520 | A1 | 9/2007 | Webb | |

(Continued)

OTHER PUBLICATIONS

Pojack Gaming, "How to Play," Jun. 8, 2009; 31 pages.

*Primary Examiner* — Dmitry Suhol
*Assistant Examiner* — David Duffy
(74) *Attorney, Agent, or Firm* — Adams Monahan, LLP; Brittany Nanzig

(57) ABSTRACT

A card game in which players compete against a dealer to obtain a poker hand and a 31-point blackjack hand that beats the dealer without busting by exceeding 31 points.

12 Claims, 7 Drawing Sheets

(56) References Cited

U.S. PATENT DOCUMENTS

2007/0228653 A1 10/2007 Lambert et al.
2007/0241506 A1 10/2007 Kling et al.
2008/0139268 A1 6/2008 Zora
2009/0085296 A1 4/2009 Webb
2010/0013157 A1 1/2010 Marquez et al.
2011/0300918 A1 * 12/2011 Sparago ..... 463/13

* cited by examiner

GAMING DEVICE AND SYSTEM AND METHOD FOR PROVIDING POKER-BLACKJACK GAME

RELATED APPLICATIONS

This application is a continuation-in-part of U.S. patent application Ser. No. 12/717,819, filed on Mar. 4, 2010, titled CARD GAMES, which relates to U.S. Patent Application Ser. No. 61/249,849 filed on Oct. 8, 2009, titled POKER BUST, and to U.S. Patent Application Ser. No. 61/157,519 filed on Mar. 4, 2009, titled POKER BUST, which are hereby incorporated by reference in their entireties.

BACKGROUND

Traditionally, card games often utilize a deck including 52 cards. These cards are often made of a heavy glossy paper or plastic material. The front surface of the card includes printed indicia thereon that distinguish the cards from each other. The rear surface of the card may be blank or can include a decorative design or pattern. The rear surface is typically the same on all cards so that one card can not be distinguished from another card by viewing the rear surface. Various games can be played using this standard deck of cards.

Card games are often now played in an electronic format online or utilizing an electronic gaming cabinet or video poker type machine. The present invention relates to a game that can be played both in the traditional format using a deck of cards or in an electronic format.

SUMMARY

In general terms, this disclosure is directed to a card game. In one possible configuration and by non-limiting example, players compete against a dealer to obtain a poker hand and a 31-point blackjack hand that beat the dealer without busting by exceeding 31 points. In another possible configuration, players compete against a dealer to obtain a poker hand and a 41-point blackjack hand that beat the dealer without busting by exceeding 41 points. In some configurations, the dealer may be one of the players, with the role of dealer rotating through each player for each hand played.

One aspect is a method of playing a card game with players and a dealer, the method comprising: obtaining wagers from each player, the wagers being of equal value and including a first wager and a second wager; dealing to each player and the dealer, in turn, three cards, wherein each of the cards dealt to a player is dealt face up; obtaining a decision from each player as to whether to draw one or more additional cards, and if so, providing the one or more additional cards; and determining whether a player has won by comparing the player's cards with the dealers cards and determining if the players cards beat the dealer's cards according to both a highest poker hand and also according to a 31-point blackjack hand or a blackjack hand with another numerical limit.

Another aspect is a method of playing a card game with players and a dealer, the method comprising: dealing two community cards; dealing one card face-up to each player; dealing one card face-down to the dealer; obtaining a decision from each player, in turn, as to whether to draw one or more additional cards, and if so, providing the one or more additional cards; providing additional cards to the dealer until a combined face value of the dealer's cards and the community cards has reached or exceeded a predetermined value; and determining whether a player has won by comparing the player's cards, including the community cards, with the dealers cards and determining if the players cards beat the dealer's cards according to both a highest poker hand and also according to a 31-point blackjack hand. The numerical limit of the blackjack hand in the previous example is 31 points. This disclosure will continue to use 31 as an example numerical limit for a blackjack hand. It should be noted that the example point totals could have a numerical of 41, 51, 61, or any other such number, in some embodiments of the present invention. Yet other aspects are described herein.

DETAILED DESCRIPTION

Various embodiments will be described in detail with reference to the drawings. Reference to various embodiments does not limit the scope of the claims attached hereto. Additionally, any examples set forth in this specification are not intended to be limiting and merely set forth some of the many possible embodiments for the appended claims.

Figure 1:
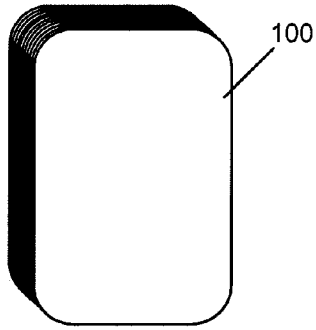
FIG. 1 is a schematic block diagram of an example deck of playing cards.
Figure 2:
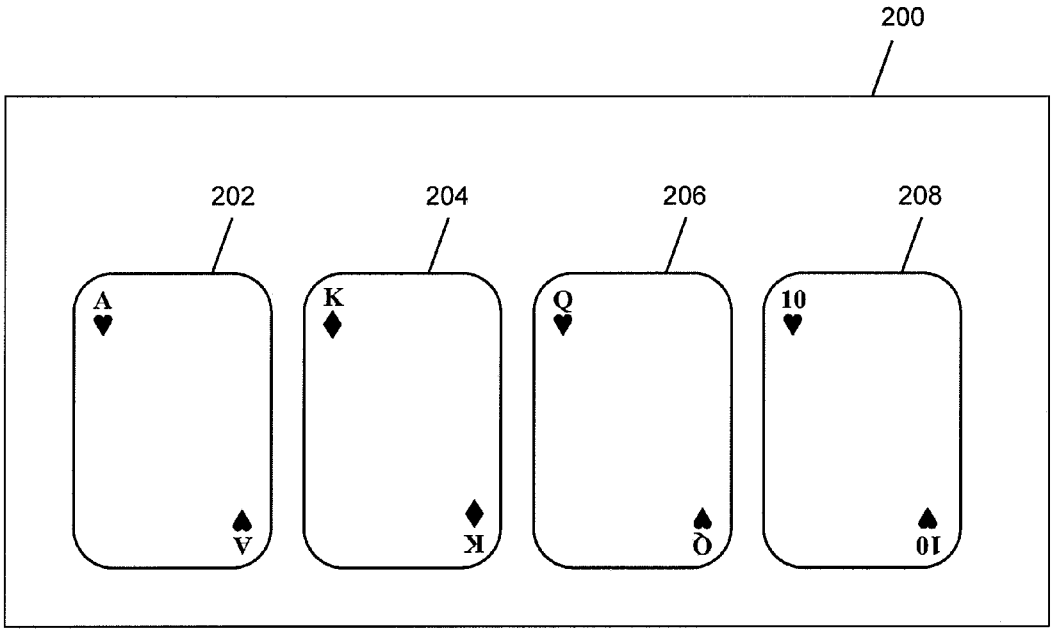
FIG. 2 is a schematic block diagram of several playing cards arranged on a table during play.
Figure 3:
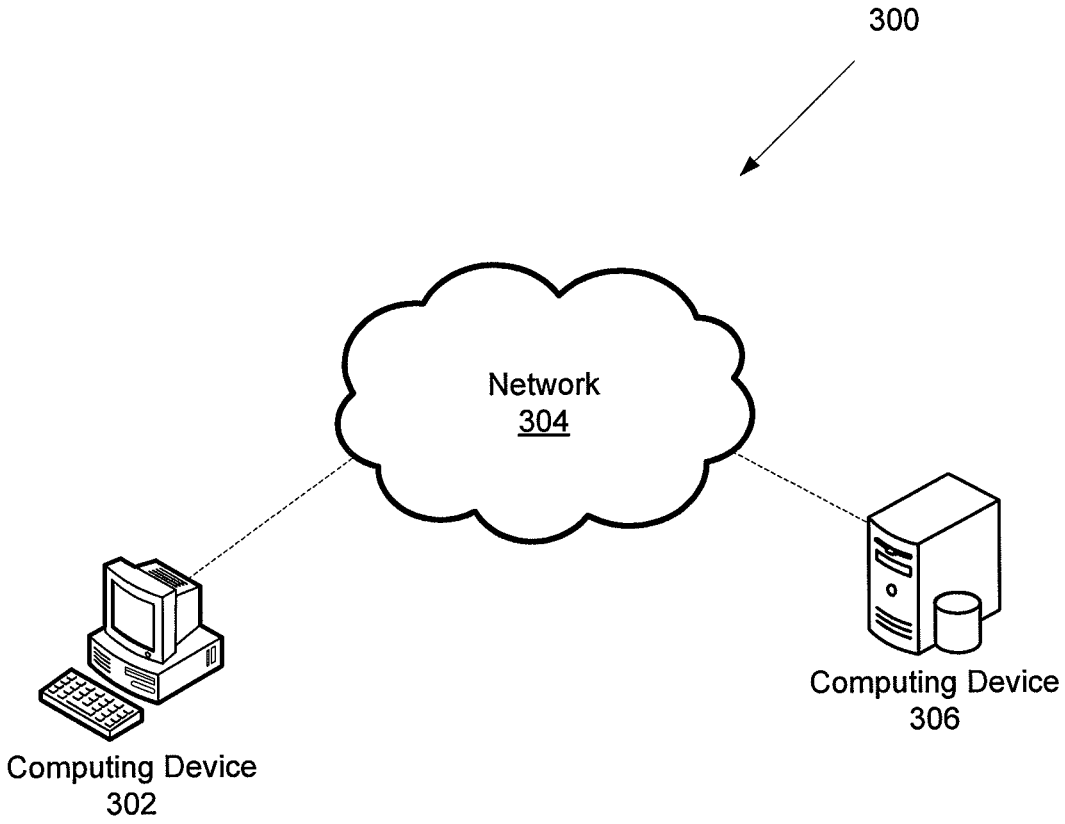
FIG. 3 is a schematic block diagram of an example computing system.

As described further below, the card games can be played using one or more standard 52-card decks of cards (such as shown in FIG. 1). Some embodiments are played on or around a table (such as shown in FIG. 2). In other examples, the card games can be played on one or more computing devices (such as shown in FIG. 3) located at establishments or in an online environment over a network such as the Internet. In some examples, when card games are played on computing devices, the computing devices generate visual representations of physical playing cards that are, for example, displayed on a display device, such as a computer monitor.

Version One

Some embodiments of the card game bring together the two popular games of blackjack and poker. The game is played by using a standard 52-card deck. The points value for each is as face value, with all picture cards counting ten points and the Ace counting one or eleven.

The object of the game is to better both the blackjack points score and poker hand of the dealer, without the player's cards totaling more than 31, or another numerical limit. As for the poker wager, the three best cards (or two or four) will be used to form a poker hand to determine winners.

Casino Version Rules

Player must make two wagers of equal value, one for the blackjack part of the game, the other for the poker game. However, it may well be viable to allow these bets to be of different amounts.

Another option would be to include a "bonus" bet that will apply only to the first three cards dealt to each player. Example: various odds being paid for any pair, straight, flush, straight flush and royal flush, all using two, three or four cards. The odds will be determined by the final math.

Each player is, in turn, dealt three cards face up. The dealer is also dealt three cards, but only two are turned face up. Or, alternately, the dealer too is dealt three cards face-up.

Each player now has a decision to make as to whether or not to draw any further cards to complete their hand.

The object is to beat the dealer on both blackjack and poker.

Players who bust (going over the set numerical limit, which could be 31. 41, 51, 61 or another number), automatically lose both bets.

The dealer must draw on soft 27 or 26—depending on the final math to the game.

When the dealer busts, all players remaining in the hand will win both bets.

Players may double down on their blackjack hand if the first three cards total 19 or 20. However, if they take that option, they can only receive one card and their turn is complete.

Aces count as 1 or 11. Therefore, should a player be dealt Ace-Ace-Nine this would total as 31 in some embodiments of the present invention.

Depending on the math of the format, several additions may be brought into the format, for the purpose of adjusting any edge that the "house" or the player may have. For example, the dealer may be allowed to also draw one soft 28, or be forced to stay on 25 and 26, if the dealer has a "made" hand in poker. A "made" hand in this instance, is defined as having a straight with three cards, a flush with three cards or four cards, or three-of-a-kind. Further adjustments to the format could also be introduced to reduce or increase the edge of the house.

For extra excitement and fun, one or two running jackpots could be offered. The main jackpot would be won by any player being dealt a royal flush on the first three cards. Example: Ace of diamonds, King of diamonds, and Queen of diamonds. The second and consolation jackpot would be paid to any player making a royal flush at any time during the hand.

An extra betting option can be offered on the poker hand from the first three cards dealt to players. Also, it is possible in all versions the card games disclosed herein that continuation bets and side bets be allowed throughout the game.

Video/Slot Machine Version

The video machine version would apply the same rules as the casino version. The only difference is that it may be one player versus the dealer, or possibly multi-player, depending on the available technology. Several additions could apply, but in general it will be presented similar to the blackjack that is currently on offer.

In some embodiments, the video machine version would be played on an electronic gaming cabinet, such as a video poker type machine in a casino or other venue.

Online Version

The same rules would apply for any online casino version, whether it be a single-player game, or a multi-player game.

Online Player Vs. Player Version

This version is played in a Limit format or even in a No Limit format.

A button (as in poker) is used to dictate the order in which players act.

Each player is dealt one card face down, and then another card face up.

First round of betting begins.

Another card is dealt face up to each player in turn. Another round of betting follows.

Each player takes however many cards to complete their hand. Players going over 31 (or other set numerical limit in other embodiments) are deemed to have busted and as such forfeit whatever monies they have contributed to the pot.

A final round of betting now takes place with a maximum of one bet and two raises. Once betting has been completed, all monies in the pot will be split between the best blackjack hand and the best poker hand, which in this instance uses three cards.

There is no minimum "score" required in blackjack. Therefore, all blackjack bets will de decided on the score closest to 31, or the set numerical limit. For example: Player A has a Nine-high straight and a total of 24. Player B has a Nine-high straight with a total of 25. Players will share the poker hand, but player B would win the blackjack hand as it is closer to 31.

A Limit betting structure that will apply is as follows in an example embodiment having a 30-60 limit. The first two rounds of betting will be 30. The third round of betting will be 60, and the fourth round will be 60 or 120 (spread limit).

The above cash game format is one of several that can be applied, including the option for the game to be played against the dealer, with one of the players being the dealer. In some embodiments, the above cash game may be played as a multi-player or ring game. There may be a designated dealer who remains the dealer throughout the entire gameplay in some embodiments. In other embodiments, a button as described above may be used to designate a rotating dealer, where the players would each act as dealer on a rotating turn basis. Embodiments of the game using a rotating dealer may be played as an online or electronic cabinet game, or they may be played as a live table game or ring game.

Version Two

Players place a wager on both the poker and blackjack hands, before the dealer deals two community cards that will form both the blackjack and poker hand for both players and dealer.

The object of the game is for players to draw further cards and to make the best blackjack hand to a total of 31 while at the same, make the best poker hand. If a player goes over 31, then the player loses both the blackjack and poker hands wager. Another option, if the player goes over 31, is to allow the poker wager hand to still be active.

After dealing the two community cards, the dealer will deal to each player one card face-up, while the dealer will be dealt one card face down.

Players then act in turn and may draw any amount of cards to improve their starting hand. Players also have the option to double down on their poker hand after they are dealt their first card.

For example, the community cards total ten and the player's card is an Ace. If a player does double down, then the player will receive just one card.

After each player has acted, it will be the dealer's turn to act. The dealer will then draw further cards if required. The dealer may be forced to refrain from taking further cards when the dealer's total stands at 27. However, depending on the final math, this total may be greater or lower than 27.

There is no soft hand as it would increase the cards the dealer needs to calculate—therefore, all Aces count as 11. If a flop contains three Aces, then that could also be an instant winner for the players in some embodiments.

A further option in this version is to allow players to have a free draw when their points total is 22, 23, 24, 25, 26. With this option, a player's wager is still active if the player's points total over 31. In embodiments wherein the points total for blackjack is 41, players may be allowed to have a free draw when their points total is 32, 33, 34, 35, 36. With this option, a player's wager is still active if the player's points total over 41.

Example Hand

The two community cards are a Queen of spades and a King of spades. This totals a point value of 20.

Player A has been dealt a deuce of spades. At this stage, player A has a total of twenty points for the blackjack hand, and a flush—in this case with three cards from all cards available—for the poker hand. If the free card option is in place and available when a player has 22 points, then player A will be dealt another card. If that card is a picture card or a Ten, then player A has bust and gone over 31. However, with the free card option, the Ten is now discarded and the player's score remains at 22 for the blackjack hand and a King-Queen-Two flush for the poker hand, which in this instance is made from three cards.

Player B has been dealt a Jack of hearts for a total of 30 points for the blackjack hand and a straight for the poker hand. Therefore, player B would in all probability not be taking any further cards.

Player C has been dealt a Six of diamonds and therefore has a point value of 26 for the blackjack hand. With the free-card option, player C would be dealt a further card. In this case, the ideal card would be the Five of spades as this would give the player a point's total of 31 for the blackjack and a Queen-King-6 for a flush. In this example, player C was dealt the Six of spades and busts. In this example, the Six is now discarded leaving the player with a point's total of 26 and a three-card poker hand of King-Queen-6.

As all three players have acted, the dealer then reveals his face-down card. In this example, the dealer's card is in fact the Seven of hearts. The dealer's blackjack hand value is therefore 27.

In this example, Player A would lose the blackjack hand and win the poker hand against the dealer.

Player B wins both the blackjack and poker hands against the dealer.

Player C loses both wagers against the dealer.

Depending on the final math, it may well require that a house be introduced into this version. One option would be for the dealer to be allowed to draw a free card on 27. For example, if the free card option is given to players on a point's total of 25 and 26, the dealer would be allowed a free card on 25, 26 and 27.

Another house edge feature is a push for all blackjack hands if the dealer's points total is at exactly 32. In the above example, if the dealer was allowed to draw a free card on 27, and draw the Five of spades (making a total of 32), not only could this be a push, but the Five of spades could be used by the dealer in the poker hand. In this case, the dealer would in fact have a flush of King-Queen-5.

Another option is to introduce a player edge when the two community cards are an Ace with a Ten or picture card. In this case, all wagers on the blackjack will be winners and paid at 3-2 or 1-2 or even 2-1.

Figure 8:
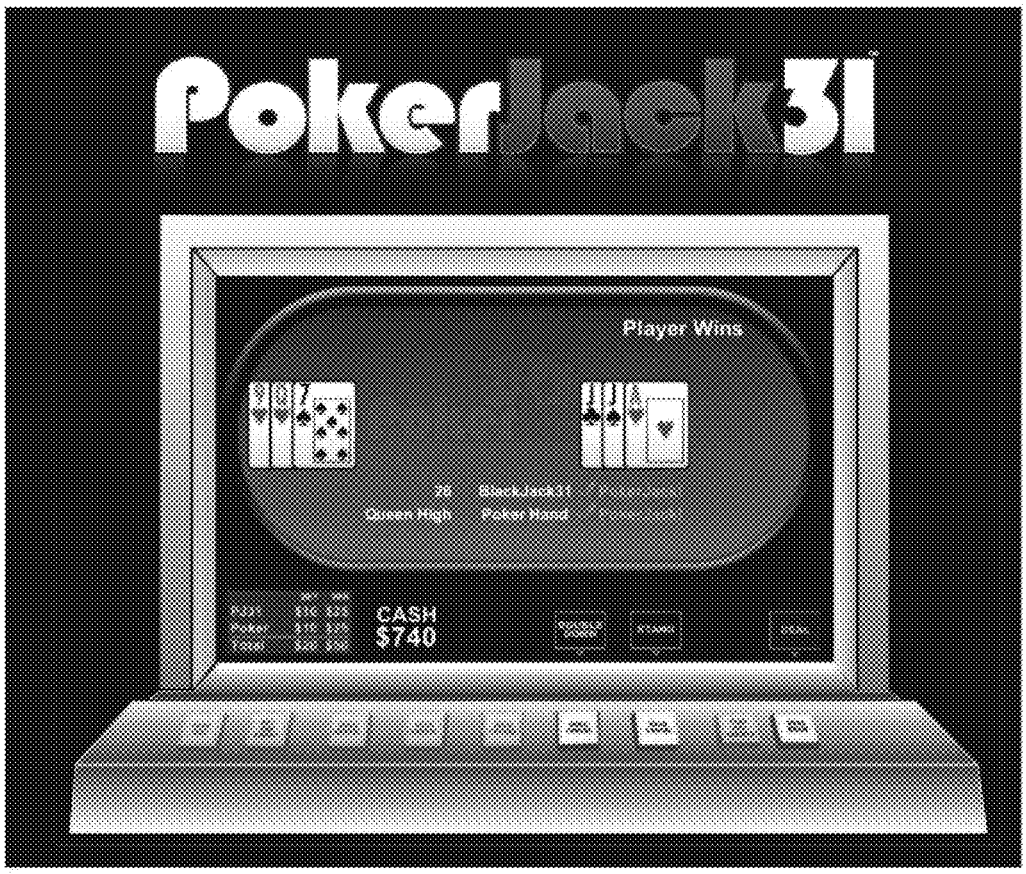
FIG. 8 is an example of one embodiment of the online or electronic game where a player has been dealt a "PokerJack" hand of two face cards and an Ace and has won the hand, receiving an additional payout for the PokerJack hand.

A further option is to introduce a player edge when two of the cards in the player's hand are any face card and the third card is an ace, as shown in FIG. 8, with an extra payout of, for example, 2-1 or 1.5-1.

Version Three

In this version, a player places a wager of equal or varying value on both a blackjack hand and a three-card poker hand. The object is to beat the dealer. Beating the dealer will pay 1-1 on each wager. The pay-out can be modified beyond 1-1.

The dealer deals three community cards from which all the players and dealer will use to form a blackjack hand to a maximum of 31 points and the poker hand, which in this case could be made using three cards.

Once the three community cards have been dealt, each player will in turn have the option to draw further cards.

Example Hand

Community cards are King of spades, Queen of spades and the Ten of diamonds.

In this example, as all three cards total 30 points, the players and the dealer will not be drawing any further cards and the hand will be a push for both wagers. As for the poker hand, again this would be a push as all the players and the dealer would have the same hand.

However, a free-card option could be introduced. This would allow the players and the dealer with an opportunity to improve their hand by drawing an ace. If any of the players do in fact draw an ace and the dealer fails to draw an ace, then that player would in effect beat the dealer in both the blackjack hand and poker hand. On the other hand, if the players fail to draw an Ace and the dealer does in fact draw an ace, then the dealer would win all wagers.

The free card option could also be offered when the three community cards total 27, 28 and 29. In such cases, depending on the total of the community cards, players and dealer would have more options to improve their hand without busting. For example:

The three community cards total 27 and contain the King and Queen of spades with the other card being the Seven of diamonds. In this case, players will be looking to improve both the blackjack hand and poker hand. For example, a player drawing an Ace, Two, Three, or a Four, would improve their total for blackjack. An Ace would also improve their poker hand by making a three-card straight.

If a player's free card is an Ace, Two, Three, or Four of spades, then the player not only improves their blackjack total, but also their poker hand by making a flush, in this case with three cards.

An additional payout could be granted for three community cards that are both blackjack and also a straight and/or royal flush: Queen, King, Ace.

A further option is to grant an additional payout if two of the cards in the player's hand are any face card and the third card is an ace, as shown in FIG. 8, with an extra payout of, for example, 2-1 or 1.5-1.

If the three community cards contain two cards of a value of Ten (any ten and any picture card), with an ace, this is deemed to be a special situation and all players would win. The payout of this could vary from 1-1 on each wager to 2-1, 3-1 or even greater on each wager.

This version allows the card games to be played in a variety of ways.

Option one is the simple version and would require no strategy by the player.

Example

Each player places equal wagers on both the blackjack and poker hands. The dealer would then deal three community cards. In any instance when the three community cards do not have a combined value of twenty-one (two cards having a value of ten and an ace); the players will be dealt further free cards to improve their hand.

Example Hand

Community cards are King of spades, Queen of spades, and Seven of diamonds. Each player therefore has a total of 27 for the blackjack hand and King-Queen-seven for the poker hand.

The dealer will therefore deal one or more free cards to each player in turn. In the above example, the number of free cards a player receives will be determined when a player busts (reaching a points total of 32 or more), or when a player reaches the best possible blackjack points total of 31.

Example Hand

First player is dealt a Two of spades. This improves both the blackjack hand (now a total of 29) and the poker hand (now a flush with three cards). However, since the player has not reached the best possible blackjack point total (31), the player will receive further cards. In this case, the player is now dealt the Ace of spades and has again improved both hands. The blackjack hand now totals 30 points and the poker hand now stands at a royal flush (in this case the poker hand is made using three cards from all the cards available).

However, since Player A's blackjack points only total 30, the player is dealt another card. If the player gets dealt another Ace, then he has reached the maximum points total for blackjack. If the card is higher than an Ace, then the player has bust (32 or over). In this example, the player is actually dealt a Three and has bust. The Three is therefore discarded and the player has to settle for a points total of 30.

The next player, Player B, gets a first free card, which is the Four of diamonds. This improves his blackjack points total to 31. Although this does not improve the player's poker hand, the player will not receive any further cards.

The next player, Player C, is now dealt a free card. In this case, the player's card is a Five of spades. Since this card now means that the player has in fact bust, the player will not receive any further free cards. The Five of spades is now discarded and the player's hand will remain at 27 for blackjack and a King-Queen-Seven high for the poker hand.

It is now the dealer's turn. If the dealer also busts, then the players who have improved either the blackjack or poker hands will be paid 1-1. The dealer will push with any player that has failed to improve either hand.

In the above example; the first two players have improved on their blackjack hand and therefore win 1-1. The first player also improved the poker hand and again will be paid at 1-1. The second player also will be paid 1-1 on the blackjack hand. However, the poker hand is the same as the dealer and is a push.

A further option is to introduce full strategy by not allowing any free cards. In this case, when a player busts, the wager is lost. As for the poker wager, there is the option to also declare the poker hand a loser when the player busts, or to keep the poker hand active. If still active, then the player would push on the poker hand if the dealer also bust.

A limited strategy is also viable by only offering a free card when the player or dealer's point value is at a certain value. For example; players may be dealt a free card on 22, 23, 24, 25, or 26, or any one or more of these. For example: Players receive a free card only when their blackjack point's score is at 24, 25, or 26.

In order to create a house edge and using the above example, the dealer could be allowed a free card on 24, 25, 26 and 27. In examples where the blackjack total is 41, the dealer could be allowed a free card on 34, 35, 36, and 37.

Another feature could be introduced whereas the players win their blackjack hand when the three community cards score a total of 30 points made up from three picture cards and/or three Tens.

A further optional wager could be offered whereas players are offered varying odds on the point's value of the three community cards. For example, for 10 points or less, the odds would be 5-1. Points totaling between 10 and 15 would pay 3-1. Points between 15 and 20 would pay 2-1. Points for 25 to 29 would pay 5-1. Points for thirty would pay 5-1 etc. These "Points Score" and odds are just an example—the final odds and which points value will be used, would be dependent on the final math.

Version Four

In this version, there is no competing dealer and only one player. Gameplay can be as in any of the above versions, except that the single player's hands are not competing against those of a dealer or other players. Instead a player's winnings or payouts are based on a predetermined pay table. The pay table sets out specified payouts for each type of hand a player may be dealt.

Simplified Version

A simplified version of the rules would therefore be as follows:

Players must place a wager on both blackjack and poker

The dealer deals three community cards from which the players and the dealer will use as part of the blackjack hand and poker hand If the three community cards total 30, or one point below the set numerical limit, then all players win the blackjack wager and tie the poker hand.

If the three community cards total 31, or the set numerical limit, then this would be classed as special situation in which all players would win. The odds for this would vary from 1-1 to 3-1 or greater.

If the three community cards total between 27 and 29, the player and the dealer would receive one free card in order to improve both hands. If the free card takes the points total over 31, then that card is discarded and player's hands will be formed from the three community cards. This also applies to the dealer.

If the three community cards total 25 or 26, the players and the dealer will receive a further free to improve their hand. If the total exceeds 31, then that card would be discarded and the hands would stand as is.

At any time when the player's blackjack hand stands at 22, 23, and 24, then the player may draw further cards. These will not be free cards and player will bust if going over 31.

Depending on the final math, when the player or dealer busts, then the three community cards will be used to form their poker hand.

FIG. 1 is a schematic block diagram of a deck of playing cards 100. A standard 52-card deck of playing cards 100 is used in some embodiments. FIG. 2 shows some of cards 100 (202, 204, 206, and 208) arranged on a table.

In some embodiments, playing cards 100 are made of paper, such as a heavy paper, thin card, or thin plastic. Playing cards 100 typically include a face surface and a back surface. The face surface typically includes markings thereon that distinguish the cards from other cards in the deck. The markings are also used to determine the permissible uses of each card according to the rules of the game being played, such as discussed in more detail herein. Examples of markings include printed indicia that identify the card as being one of an Ace, 2, 3, 4, 5, 6, 7, 8, 9, 10, Jack, Queen, and King, and also identify the card as being of a suit selected from diamonds, clubs, hearts, and spades, in some embodiments.

FIG. 3 is a schematic block diagram of an example computing system 300. The example computing system 300 includes at least one computing device 302. In some embodiments the computing system 300 further includes a communication network 304 and one or more additional computing devices 306 (such as a server).

Computing device 302 can be, for example, located in a gaming establishment or can be a computing device located in a user's home. Computing device 302 can be a stand-alone computing device 302 or a networked computing device that communicates with one or more other computing devices 306 across network 304. Computing device 306 can be, for example, located remote from computing device 302, but configured for data communication with computing device 302 across network 304.

Figure 3A:
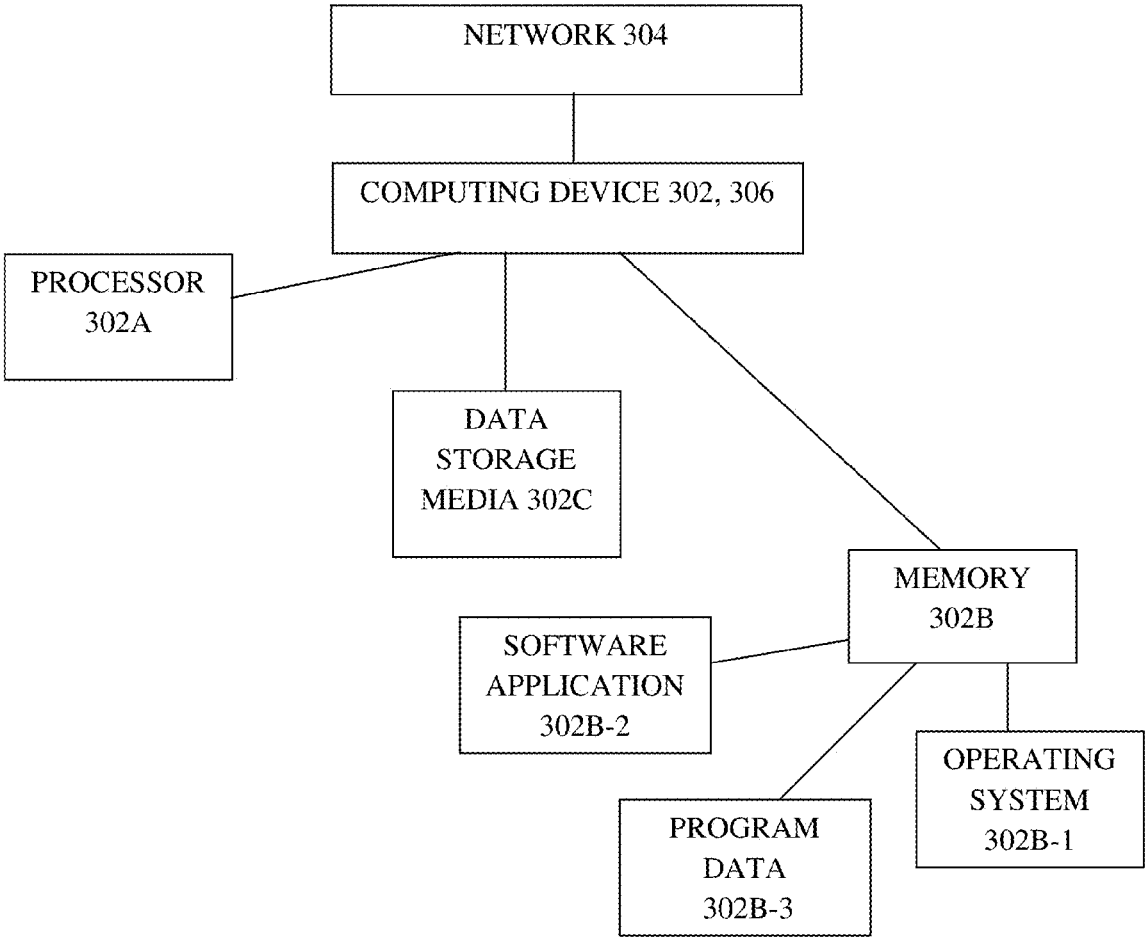
FIG. 3A is a schematic block diagram of an example computing system.

FIG. 3A is a schematic block diagram of an example computing device 302 or 306. In some examples, the computing devices 302 and 306 include at least one processor or processing unit 302A and system memory 302B. Depending on the exact configuration and type of computing device, the system memory 302B may be volatile (such as RAM), nonvolatile (such as ROM, flash memory, etc.) or some combination of the two. System memory 302B typically includes an operating system 302B-1 suitable for controlling the operation of the computing device, such as the WINDOWS® operating systems from Microsoft Corporation of Redmond, Wash. or a server, such as Windows SharePoint Server, also from Microsoft Corporation. The system memory 302B may also include one or more software applications 302B-2 and may include program data 302B-3.

The computing device may have additional features or functionality. For example, the device may also include additional data storage devices 302C (removable and/or non-removable) such as, for example, magnetic disks, optical disks, or tape. Computer storage media 302C may include volatile and nonvolatile, removable and non-removable media implemented in any method or technology for storage of information, such as computer readable instructions, data structures, program modules, or other data. System memory, removable storage, and non-removable storage are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by the computing device. An example of computer storage media is non-transitory media.

Figure 3B:
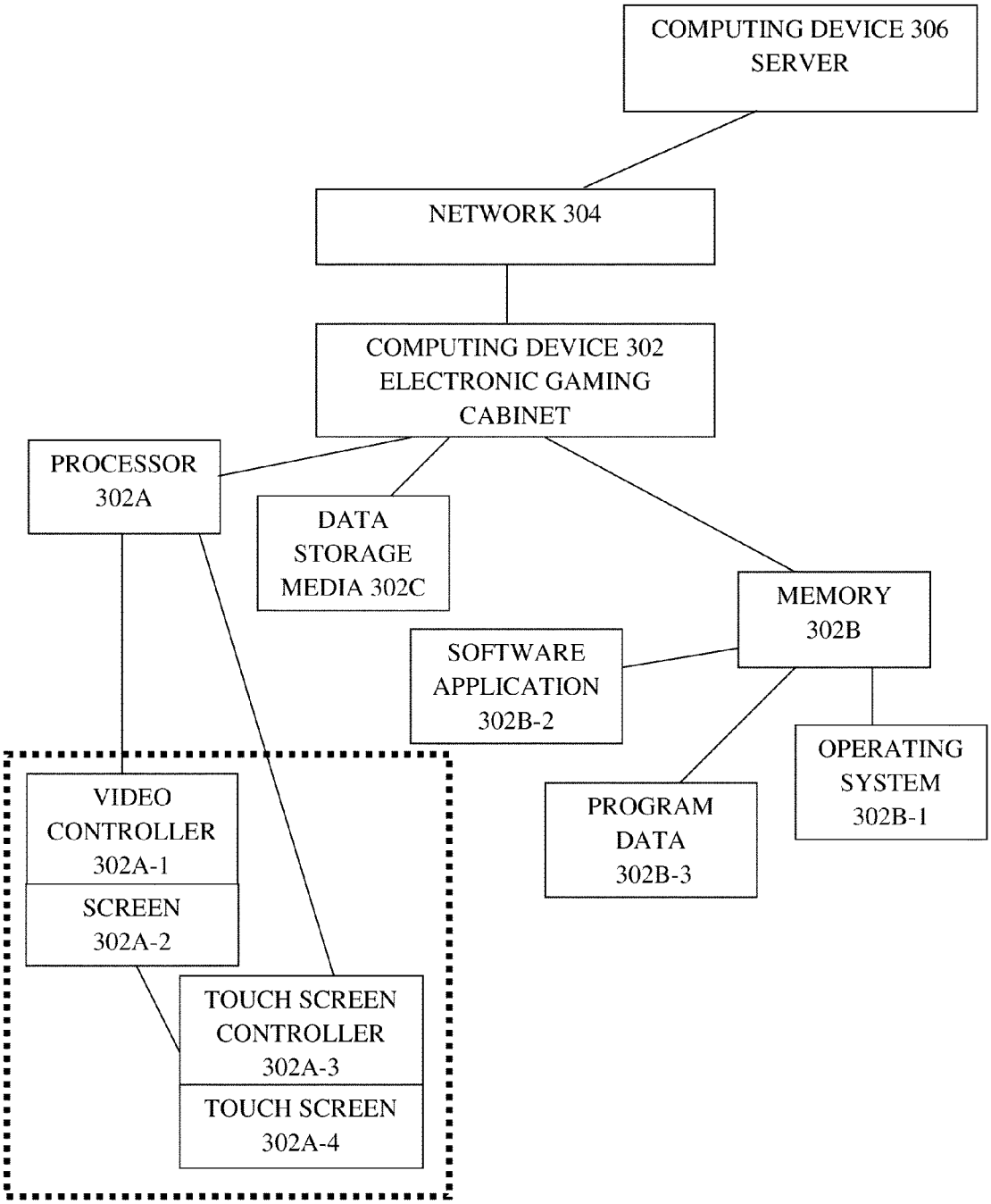
FIG. 3B is a schematic block diagram of an example computing system.

In some examples, one or more of the computing devices 302, 306 can be a gaming cabinet or video poker terminal located in an establishment, such as a casino or bar. A schematic diagram of such a device is shown in FIG. 3B. The computing device 302 may be an electronic gaming machine with input device options including, but not limited to, a video controller 302A-1, a screen 302A-2, a touch screen controller 302A-3, or a touch screen 302A-4. In other examples, the computing device can be a personal computing device that is networked to allow the user to play card games disclosed herein at a remote location, such as in a player's home or other location. In some embodiments, computing device 302 is a smart phone or other mobile device. In some embodiments the rules of game play are stored as data instructions for a SmartPhone application. A network 304 facilitates communication between the computing device 302 and one or more servers, such as computing device 306, that host the card games. The network 304 may be a wide variety of different types of electronic communication networks. For example, the network may be a wide-area network, such as the Internet, a local-area network, a metropolitan-area network, or another type of electronic communication network. The network may include wired and/or wireless data links. A variety of communications protocols may be used in the network 108 including, but not limited to, Ethernet, Transport Control Protocol (TCP), Internet Protocol (IP), Hypertext Transfer Protocol (HTTP), SOAP, remote procedure call protocols, and/or other types of communications protocols.

In some examples, computing device 306 is a Web server. In this example, computing device 302 includes a Web browser that communicates with the Web server to request and retrieve data. The data is then displayed to the user, such as using a Web browser software application. In some embodiments, the various operations, methods, and rules disclosed herein are implemented by instructions stored in memory. When the instructions are executed by the processor of one or more of computing devices 302 and 306, the instructions cause the processor to perform one or more of the operations or methods disclosed herein. Examples of operations include the operations of game play and enforcement of one or more rules of the game.

Figure 4:
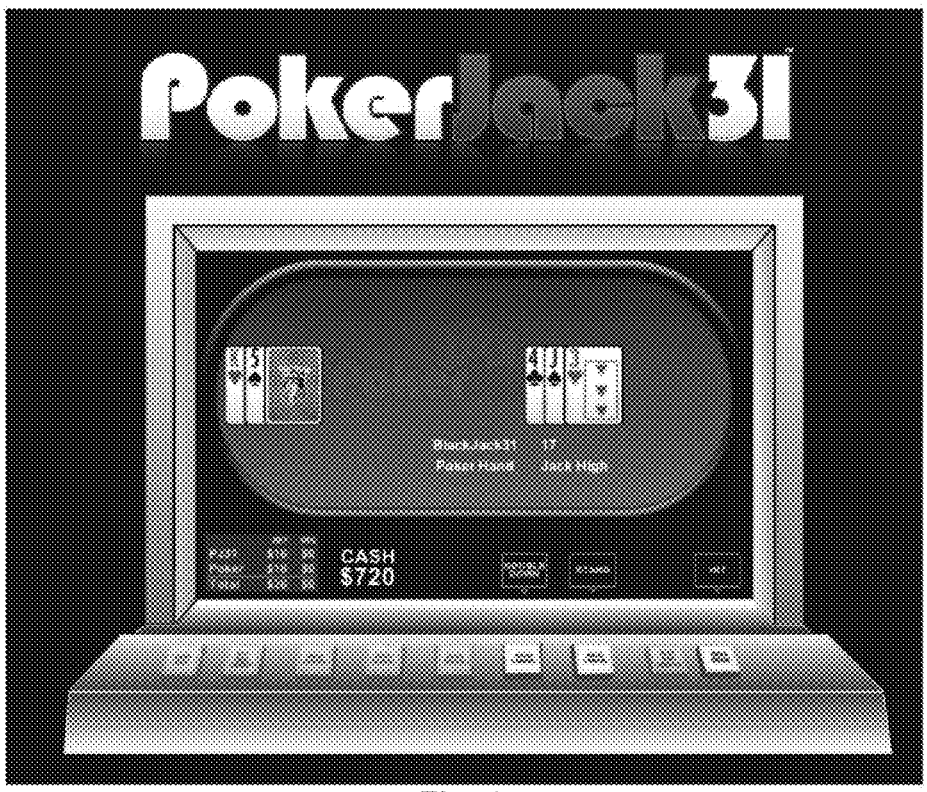
FIG. 4 is an example of one embodiment of the online or electronic game.

In FIG. 4, a player has a BlackJack31 hand of 17 and a poker hand of Jack High in an example of one embodiment of the online or electronic game.

Figure 5:
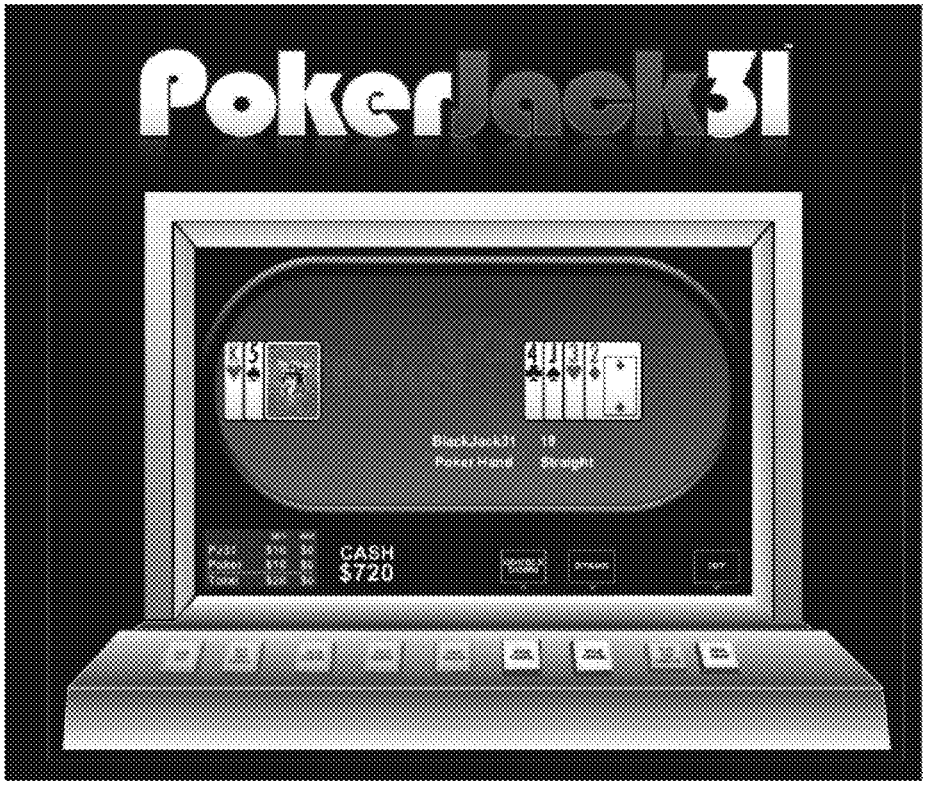
FIG. 5 is an example of one embodiment of the online or electronic game.

In FIG. 5, a player has a BlackJack31 hand of 19 and a poker hand of Straight in an example of one embodiment of the online or electronic game.

Figure 6:
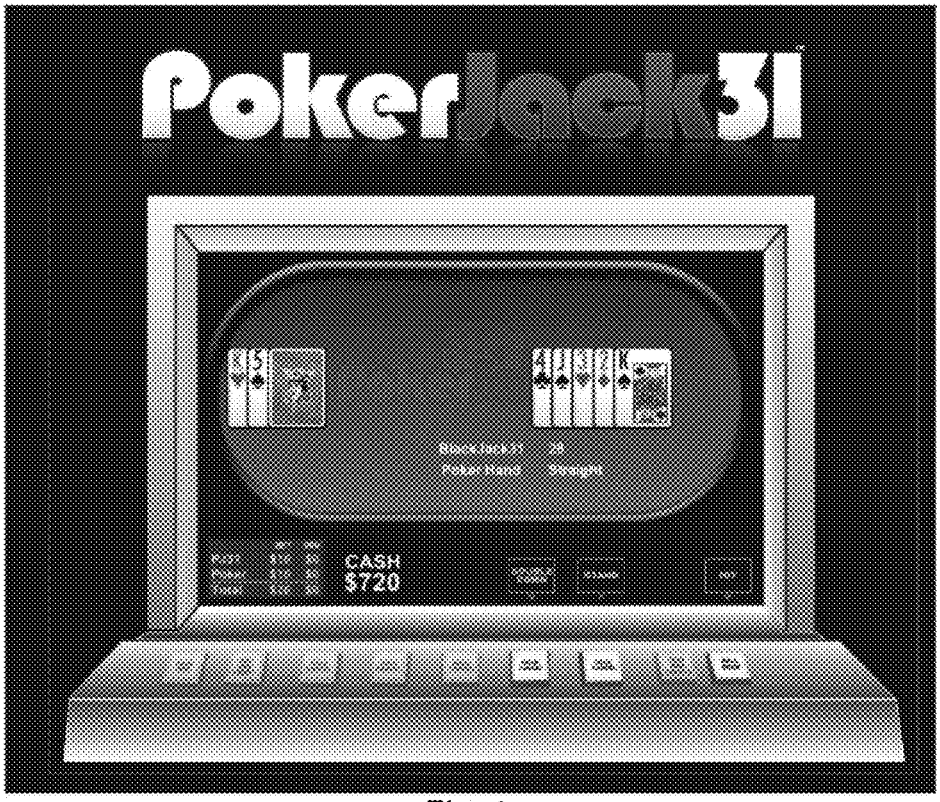
FIG. 6 is an example of one embodiment of the online or electronic game.

In FIG. 6, a player has a BlackJack31 hand of 29 and a poker hand of Straight in an example of one embodiment of the online or electronic game.

Figure 7:
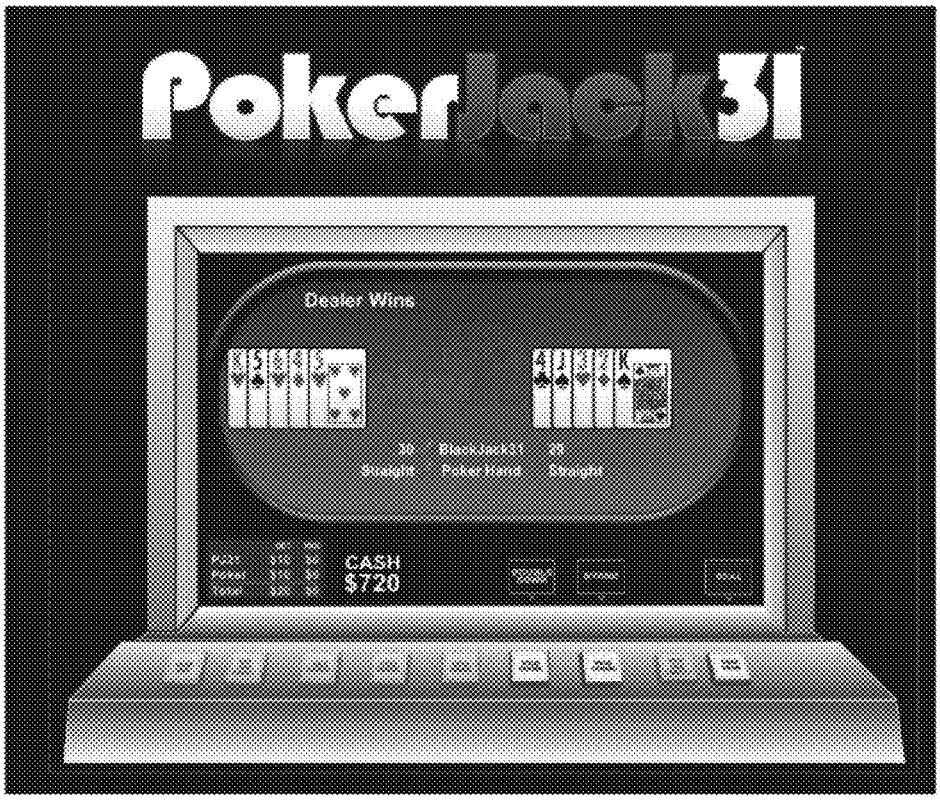
FIG. 7 is an example of one embodiment of the online or electronic game; the dealer has won this hand.

In FIG. 7, a player has a BlackJack31 hand of 29 and a poker hand of Straight, and a dealer has a BlackJack31 hand of 30 and a poker hand of Straight in an example of one embodiment of the online or electronic game; the dealer has won this hand.

In FIG. 8, a player has been dealt an advantageous hand of two face cards and an Ace and has won the hand, receiving an additional payout for the hand, in an example of one embodiment of the online or electronic game.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A method of operating a gaming system, wherein a game is played between a dealer and at least one player, said method comprising:

(a) causing at least one processor to execute a plurality of instructions stored in at least one memory device to operate with at least one input device to receive a first wager and a second wager, the first and second wagers being of equal value, from a first player for a play of a game;

(b) after receiving the first and second wagers, causing the at least one processor to execute the plurality of instructions stored in the at least one memory device to determine a plurality of playing cards for an initial player hand and an initial dealer hand for said play of the game from a virtual deck of playing cards;

(c) causing the at least one processor to execute the plurality of instructions stored in the at least one memory device to operate with at least one display device to display the plurality of cards of the initial player hand and the initial dealer hand face up;

(d) causing the at least one processor to execute the plurality of instructions stored in the at least one memory device to operate with the at least one input device to receive an optional request from the first player for at least one player draw card from the virtual deck of playing cards;

(e) causing the at least one processor to execute the plurality of instructions stored in the at least one memory device to operate with the at least one display device to display the at least one player draw card face-up into the initial player hand from the virtual deck of playing cards;

(f) causing the at least one processor to execute the plurality of instructions stored in the at least one memory device to operate with the at least one display device to display at least one dealer draw card face-up in the initial dealer hand from the virtual deck of playing cards;

(g) causing the at least one processor to execute the plurality of instructions stored in the at least one memory device to determine whether the initial player hand and the at least one player draw card hand beats the initial dealer hand and the at least one dealer draw card according to both a highest poker hand and also according to a blackjack hand played according to a blackjack point total of 31 points;

(h) causing the at least one processor to execute the plurality of instructions stored in the at least one memory device to determine any awards to be provided to the first player based on the comparison to the dealer hand and according to a pay table; and (i) causing the at least one processor to execute the plurality of instructions stored in the at least one memory device to cause any determined awards to be provided to the first player.

2. The method of claim 1, which is provided through a data network.

3. The method of claim 2, wherein the data network is an internet.

4. The method of claim 2, wherein the data network is a wireless network.

5. The method of claim 1, wherein the blackjack hand is played according to a point total greater than 31 points.

6. The method of claim 1, wherein a different player acts as dealer each hand.

7. The method of claim 1, wherein a player receives an additional payout if the player's first three cards consist of two face cards and an Ace.

8. A method of playing a card game with players and a dealer in a computing system comprising at least one server to host the card game and at least one computing device communicably coupled to the at least one server through a communication network, the method comprising:

(a) obtaining wagers from each player through the at least one computing device, the wagers being of equal value and including a first wager and a second wager;

(b) dealing to the each player and the dealer, in turn, three cards through the at least one server, wherein each of the cards dealt to a player is dealt face up;

(c) obtaining a decision from the each player through the at least one computing device as to whether to draw one or more additional cards, and if so, providing the one or more additional cards through the at least one server; and (d) determining a total score of the player's cards through the at least one server for establishing the formation of a blackjack hand for the each player, wherein the blackjack hand is a 31-point blackjack hand formed when the total score is up to a maximum of 31 points; and (e) determining whether a player has won by comparing the player's cards with the dealer's cards through the at least one server based on the total score, and determining if the player's cards beat the dealer's cards according to both a highest poker hand and also according to a the 31-poker blackjack hand, through the at least one server.

9. The method of claim 8, wherein each of the at least one computing device is one of a mobile device and a computer communicably coupled with the at least one server for data communication.

10. The method of claim 9, wherein at least one computing device is located at one of a gaming establishment and at least one computing device is located in a remote location.

11. A method of operating a gaming system, wherein a game is played between a dealer and at least one player, said method comprising:

(a) causing at least one processor to execute a plurality of instructions stored in at least one memory device to operate with at least one input device to receive a first wager and a second wager, the first and second wagers being of equal value, from a first player for a play of a game;

(b) after receiving the first and second wagers, causing the at least one processor to execute the plurality of instructions stored in the at least one memory device to determine a plurality of playing cards for an initial player hand and an initial dealer hand for said play of the game from a virtual deck of playing cards;

(c) causing the at least one processor to execute the plurality of instructions stored in the at least one memory device to operate with at least one display device to display the plurality of cards of the initial player hand face up and to display the plurality of cards of the initial dealer hand face-up with one card dealt face down;

(d) causing the at least one processor to execute the plurality of instructions stored in the at least one memory device to operate with the at least one input device to receive an optional request from the first player for at least one player draw card from the virtual deck of playing cards;

(e) causing the at least one processor to execute the plurality of instructions stored in the at least one memory device to operate with the at least one display device to display the at least one player draw card face-up into the initial player hand from the virtual deck of playing cards;

(f) causing the at least one processor to execute the plurality of instructions stored in the at least one memory device to operate with the at least one display device to display the face down card from the initial dealer hand displayed face-up, with the option for at least one dealer draw card to also be dealt face up;

(g) causing the at least one processor to execute the plurality of instructions stored in the at least one memory device to determine whether the initial player hand and the at least one player draw card hand beats the initial dealer hand and the at least one dealer draw card according to both a highest poker hand and also according to a blackjack hand played according to a blackjack point total of 31 points;

(h) causing the at least one processor to execute the plurality of instructions stored in the at least one memory device to determine any awards to be provided to the first player based on the comparison to the dealer hand and according to a pay table; and (i) causing the at least one processor to execute the plurality of instructions stored in the at least one memory device to cause any determined awards to be provided to the first player.

12. The method of claim 11, wherein the blackjack hand is played according to a point total greater than 31 points.

* * * * *